US009707659B2

(12) United States Patent
Ogata et al.

(10) Patent No.: US 9,707,659 B2
(45) Date of Patent: Jul. 18, 2017

(54) METHOD AND APPARATUS FOR POLISHING WORKPIECE

(75) Inventors: Shinichi Ogata, Tokyo (JP); Ryuichi Tanimoto, Tokyo (JP); Keiichi Takanashi, Tokyo (JP)

(73) Assignee: SUMCO Corporation, Tokyo (JP)

( * ) Notice: Subject to any disclaimer, the term of this patent is extended or adjusted under 35 U.S.C. 154(b) by 702 days.

(21) Appl. No.: 13/976,205

(22) PCT Filed: Oct. 19, 2011

(86) PCT No.: PCT/JP2011/005856

§ 371 (c)(1),
(2), (4) Date: Sep. 3, 2013

(87) PCT Pub. No.: WO2012/090366

PCT Pub. Date: Jul. 5, 2012

(65) Prior Publication Data

US 2013/0337723 A1 Dec. 19, 2013

(30) Foreign Application Priority Data

Dec. 27, 2010 (JP) ..... 2010-290353

(51) Int. Cl.

| | |
|---|---|
| ***B24B 37/005*** | (2012.01) |
| ***B24B 37/015*** | (2012.01) |
| ***B24B 37/08*** | (2012.01) |
| ***B24B 37/14*** | (2012.01) |
| ***B24B 49/14*** | (2006.01) |

(52) U.S. Cl.

CPC ..... *B24B 37/005* (2013.01); *B24B 37/015* (2013.01); *B24B 37/08* (2013.01); *B24B 49/14* (2013.01)

(58) Field of Classification Search

CPC ..... B24B 37/08; B24B 37/28; B24B 37/013; B24B 37/005

USPC ..... 451/41, 8, 364

See application file for complete search history.

(56) References Cited

U.S. PATENT DOCUMENTS 5,969,521 A 10/1999 Kurita et al.
7,029,369 B2 * 4/2006 Mikhaylich ..... B24B 21/04 451/307
2005/0048875 A1 * 3/2005 Koo ..... B24B 37/013 451/7

(Continued)

FOREIGN PATENT DOCUMENTS

JP 2000-271857 A 10/2000
JP 2000271857 A * 10/2000

(Continued)

OTHER PUBLICATIONS

Office Action in corresponding Taiwanese Patent App. No. 100140404, dated Dec. 2, 2014 (4 pages).

(Continued)

*Primary Examiner* — Larry E Waggle, Jr.
*Assistant Examiner* — Lauren Beronja
(74) *Attorney, Agent, or Firm* — Reza Mollaaghababa; Thomas J. Engellenner; Pepper Hamilton LLP

(57) ABSTRACT

In a polishing method of the present invention, the temperature of a carrier plate is measured, and the amount of polishing removal of a workpiece (workpiece) is accurately controlled based on change in the measured temperature of the carrier plate.

12 Claims, 15 Drawing Sheets

(56) References Cited

U.S. PATENT DOCUMENTS

| | | | | |
|---|---|---|---|---|
| 2008/0233840 | A1* | 9/2008 | Pietsch | B24B 37/08 451/41 |
| 2009/0075574 | A1* | 3/2009 | Tokukra et al. | 451/364 |

FOREIGN PATENT DOCUMENTS

| | | | | |
|---|---|---|---|---|
| JP | 2001353658 | A | * | 12/2001 |
| JP | 2003197586 | A | | 7/2003 |
| JP | 20055317 | A | | 1/2005 |
| JP | 2002254299 | A | | 9/2009 |
| WO | 00/12263 | A | | 3/2000 |

OTHER PUBLICATIONS

International Search Report, PCT/JP2011/005856, mailed Nov. 22, 2011 (2 pages).
Office Action in corresponding Korean patent application 10-2013-7015040, dated Mar. 20, 2014 (4 pages).

* cited by examiner (a)

(b)

METHOD AND APPARATUS FOR POLISHING WORKPIECE

TECHNICAL FIELD

The present invention relates to a method and an apparatus for polishing a workpiece. The present invention relates in particular to a method and an apparatus for polishing a workpiece, which make it possible to accurately control the amount of polishing on a circular workpiece such as a semiconductor wafer which is required to be very flat.

BACKGROUND ART

In the production of semiconductor wafers such as a silicon wafer, which is a typical example of a workpiece to be polished, double side polishing for simultaneously polishing the front and back surfaces of the wafers is generally employed to achieve more accurately controlled flatness quality and surface roughness quality of the wafers. The shape required for a semiconductor wafer (primarily the degree of flatness required for the whole surface and the periphery of the wafer) varies depending on the uses. It is necessary to determine the target amount of polishing of wafers depending on the requirements, and to accurately control the amount of polishing removal.

In particular, in recent years, due to miniaturization of semiconductor devices and increase in the diameter of semiconductor wafers, higher flatness are heavily required for semiconductor wafers subjected to light exposure. Against this background, techniques for accurately controlling the amount of polishing on wafers are strongly desired.

In this regard, for example, PTL 1 (JP 2002-254299A) discloses a method of controlling the amount of polishing on a wafer in accordance with the drop in the driving torque of polishing plates of a double side polishing apparatus during polishing.

CITATION LIST

Patent Literature

PTL 1: JP 2002-254299A

SUMMARY OF INVENTION

Technical Problem

However, the method disclosed by PTL 1 cannot sufficiently follow the change in the polishing plate torque, and it is difficult to determine the correlation between the amount of change in torque and the amount of polishing removal of a wafer. Further, the method detects a great torque change occurring when a member for holding a wafer (carrier plate) and a polishing plate are brought into contact, and determines the point as the polishing termination point. Therefore, the amount of polishing removal cannot be detected in a state where the carrier plate and the polishing plate are not in contact with each other. This has been a problem.

The present invention is directed to solving the foregoing problems, and it is an object of the present invention to provide a method and an apparatus for polishing wafers, which make it possible to accurately control the amount of polishing removal on wafers in double side polishing of wafers.

Solution to Problem

The inventors made various studies to solve the foregoing problems.

As a result, they newly found that the temperature of a carrier plate for holding a wafer serves as an accurate indication of the amount of polishing on the wafer in a double side polishing apparatus, and they made a new finding that the amount of polishing removal can be accurately controlled by measuring the temperature of the carrier plate thereby achieving the target amount of polishing removal.

The present invention is based on the above findings and it primarily includes the following components.

(1) A method for polishing a workpiece, in which a front surface and a back surface of the workpiece is simultaneously polished by holding a workpiece in a carrier plate having one or more retention openings each for retaining a workpiece, at least one of the retention openings being eccentrically disposed, and by rotating at least the carrier plate between an upper polishing plate and a lower polishing plate on each of which a polishing pad is pasted, with polishing slurry being supplied, wherein a temperature of the carrier plate is measured, and amount of polishing removal of the workpiece is accurately controlled based on change in the measured temperature of the carrier plate.

(2) The method for polishing a workpiece, according to (1) above, wherein the amount of polishing removal of the workpiece is controlled based on change of phase calculated from the change in the temperature of the carrier plate.

Here, the "phase calculated from the change in the temperature of the carrier plate" means the phase of the oscillating component in the temperature change of the carrier plate; the oscillating component is synchronized with the rotation of the carrier plate during double side polishing of a workpiece. The calculation methods of the oscillating component in the temperature change of the carrier plate and the phase of the oscillating component include, but not limited to a calculation method such as the FFT (fast Fourier transform) to be described later or the least square method using a model.

(3) The method for polishing a workpiece, according to (1) above, wherein the amount of polishing removal of the workpiece is controlled based on change of amplitude calculated from the change in the temperature of the carrier plate.

Here, the "amplitude calculated from the change in the temperature of the carrier plate" means the amplitude of the oscillating component in the temperature change of the carrier plate; the oscillating component is synchronized with the rotation of the carrier plate during double side polishing of a workpiece. The calculation methods of the oscillating component in the temperature change of the carrier plate and the amplitude of the oscillating component include, but not limited to a calculation method such as the FFT (fast Fourier transform) to be described later or the least square method using a model.

(4) The method for polishing a workpiece, according to (1) above, wherein the amount of polishing removal of the workpiece is controlled based on both change of phase and amplitude change calculated from the change in the temperature of the carrier plate.

(5) The method for polishing a workpiece, according to any one of (1) to (4) above, wherein the polishing is performed with an outer edge of the carrier plate being protruded outward in a radial direction from the edges of the upper and lower polishing plates, and a temperature of the protruded outer edge of the carrier plate is measured with an optical temperature measurement means.

(6) An apparatus for polishing both surfaces of a workpiece, including: a rotatable carrier plate in which one or more retention openings each for retaining a workpiece to be polished is formed, at least one of the retention openings being eccentrically disposed; and a lower polishing plate and an upper polishing plate paired with the lower polishing plate for carrying the carrier plate, comprising: a means for measuring a temperature of the carrier plate; and a control means for controlling amount of polishing removal of the wafer in accordance with the measured temperature.

(7) The apparatus for polishing a workpiece, according to (6) above, wherein the temperature measurement means is an optical measurement means.

Advantageous Effect of Invention

According to the present invention, the amount of polishing on wafers is accurately controlled in double side polishing of the wafers, which makes it possible to produce very flat semiconductor wafers having desired shapes.

Further, the accurate control of the amount of polishing removal renders repolishing for making up the lack of polishing unnecessary, which allows the productivity of the wafer production process to be improved.

Moreover, the amount of polishing removal would not exceed the intended amount, which can prevent wafer defects and wear of a carrier plate.

BRIEF DESCRIPTION OF DRAWINGS

FIG. 3(*b*) is a diagram schematically showing the contact between the carrier plate and upper and lower polishing plates. FIG. 3(*c*) is a graph showing the relationship between the distance of a portion of a carrier plate from a wafer and the pressure applied to the carrier plate.

FIG. 4(*b*) is a diagram schematically showing the contact between the carrier plate and upper and lower polishing plates. FIG. 4(*c*) is a graph showing the relationship between the distance of a part of a carrier plate from a wafer and the pressure applied to the carrier plate.

FIG. 5(*b*) is a graph showing the relationship between the polishing time and the peak value of the amplitude in the temperature change of the carrier plate.

FIGS. 6(*b*) and 6(*c*) are diagrams showing the state of measuring the temperature of the outer edge of a carrier plate using the double side polishing apparatus in FIG. 6(*a*).

DESCRIPTION OF EMBODIMENTS

Hereinafter, the background of how the present invention has been achieved will be described.

The amount of polishing removal of a wafer connote be sufficiently controlled by the conventional control the based on the change in toque as described above; therefore, the inventors eagerly sought an alternative measure. Since the temperature of slurry significantly changes in a late stage of polishing, they focused on the fact that some temperature change of parts in a polishing apparatus and a supply material (slurry), and the like during polishing can be suitable as an indication of the amount of polishing removal of a wafer.

Figure 1:
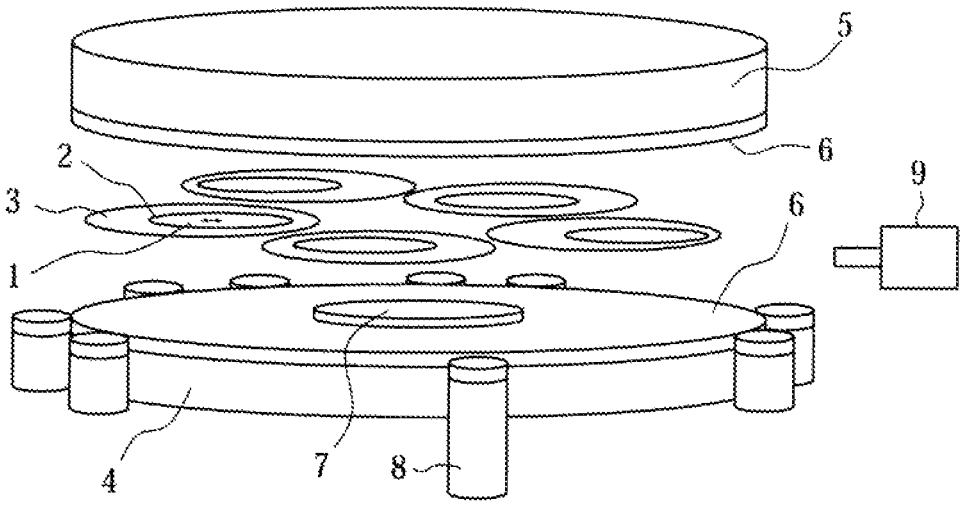
FIG. 1 is a schematic perspective view showing a prototype of a double side polishing apparatus.

Accordingly, the inventors first made a prototype of a polishing apparatus shown in FIG. 1 in order to measure the temperature of parts in the polishing apparatus and a supply material.

As shown in FIG. 1, this double side polishing apparatus includes one or more carrier plates 3 (five carrier plates in the illustration) each having a retention opening 2 for retaining a wafer 1, a lower polishing plate 4 for carrying these carrier plates 3, and an upper polishing plate 5 paired with the lower polishing plate 4.

Polishing pads 6 are pasted on the surfaces of the upper and lower polishing plates 4 and 5, which face each other.

The carrier plates 3 are rotatable. In the illustration, each carrier plate 3 can be rotated by a sun gear 7 and internal gears 8.

The carrier plates 3 each have one or more retention openings 2 (one retention opening in the illustration) and the retention openings 2 are eccentric to the center of each carrier plate 3.

Further, this polishing apparatus includes a temperature measurement means 9 for measuring the temperature of the carrier plates 3.

First, the inventors double polished a wafer using the apparatus shown in FIG. 1 and measured the temperature of polishing slurry during polishing to examine the relationship between the temperature and the amount of polishing removal. However, they could not find the expected degree of correlation. In other words, the temperature of the polishing slurry was found to be affected by the discharge path, resulting in poor reliability and repeatability.

Next, the inventors focused on the fact that the change in the temperature of polishing slurry was originally due to the change in the temperature of components of the polishing apparatus. This being the case, the temperatures of the carrier plates 3, the upper polishing plate 5, and a discharge tank disposed around the upper and lower polishing plates as the components of the polishing apparatus were measured, and the relationship between the temperatures and the polishing time was evaluated. Note that a Thermo Tracer manufactured by NEC San-ei Instruments, Ltd. was used as the temperature measurement means 9 at a wavelength of 8 μm to 14 μm for a sampling period of 10 s to measure the temperatures of the components from one direction.

Figure 2:
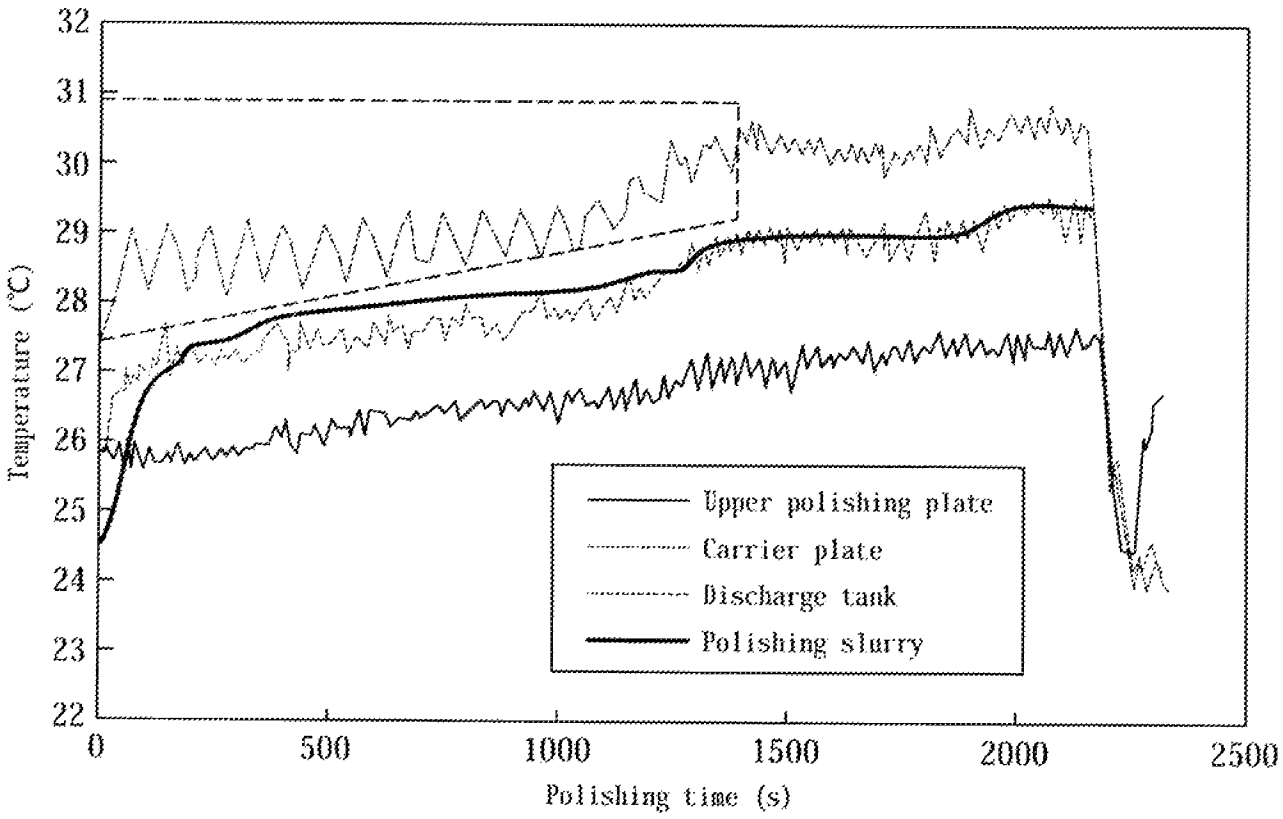
FIG. 2 is a graph showing the relationship between the polishing time and the temperatures of components of a double side polishing apparatus.

The change in the temperature of each component over the polishing time is shown in FIG. 2.

As shown in FIG. 2, the carrier plate was found to be higher in temperature during polishing as compared with the discharge tank and the upper polishing plate. In particular, they also found that the temperature of the carrier plate characteristically has significant periodicity synchronized with the rotation of the carrier plate in an early stage of polishing, the temperature rises with the polishing time, and the carrier plate is less affected by an external cause in terms of temperature unlike polishing slurry.

The inventors sought the cause of the above temperature change of the carrier plate to find the following. The findings will be described with reference to FIGS. 3(*a*) to 3(*c*) and FIGS. 4(*a*) to 4(*c*).

Figure 3:
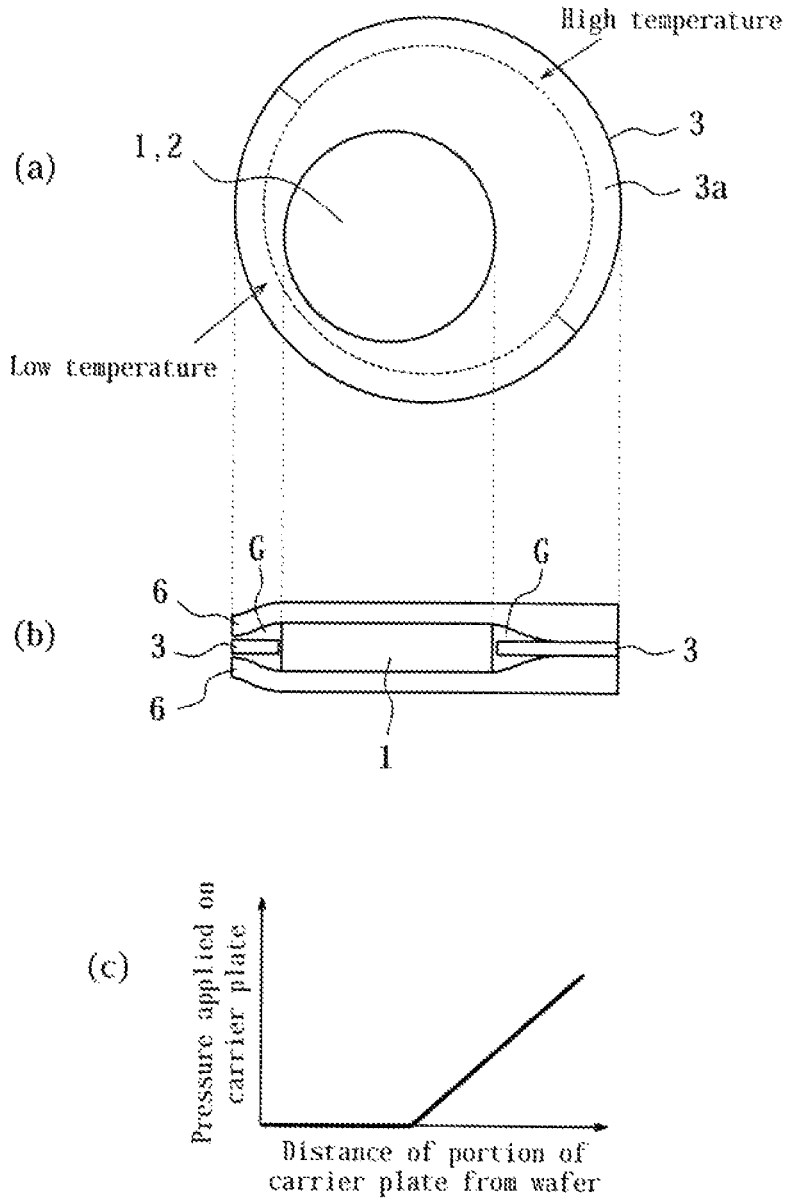
FIG. 3(*a*) is a diagram schematically showing the temperature state of the outer edge of a carrier plate.

FIGS. 3(*a*) to 3(*c*) show (a): the temperature distribution of an outer edge 3*a* of a carrier plate 3. (b): the contact of a wafer 1 and a carrier plate 3 with polishing pads 6, and (c): the relationship between the pressure applied to a portion of the carrier plate and the distance of the portion from the wafer, in an early stage of polishing.

The outer edge 3*a* here refers to a region ranging within 30 mm in the radial direction inward from the end of the edge of the carrier plate.

As shown in FIG. 3(*a*), the wafer 1 is retained in a retention opening 2 of the carrier plate 3 and the center of the wafer 1 is eccentric to the center of the carrier plate 3.

Here, the thickness of the wafer 1 is larger than the thickness of the carrier plate 3 in an early stage of polishing as shown in FIG. 3(*b*). Therefore, the polishing pads 6 are forced against the outer edge 3*a* of a part of the carrier plate 3 due to the elasticity of the polishing pads 6. Specifically, as shown in FIG. 3(*c*), the pressure applied to the carrier plate 3 by the polishing pad 6 is increased as the distance from the wafer 1 is increased. Regions in the vicinity of the contact portions are slid on the polishing pads 6 to generate frictional heat; thus, the temperature of the contact portions become higher as compared with other portions as shown in FIG. 3(*a*).

Figure 4:
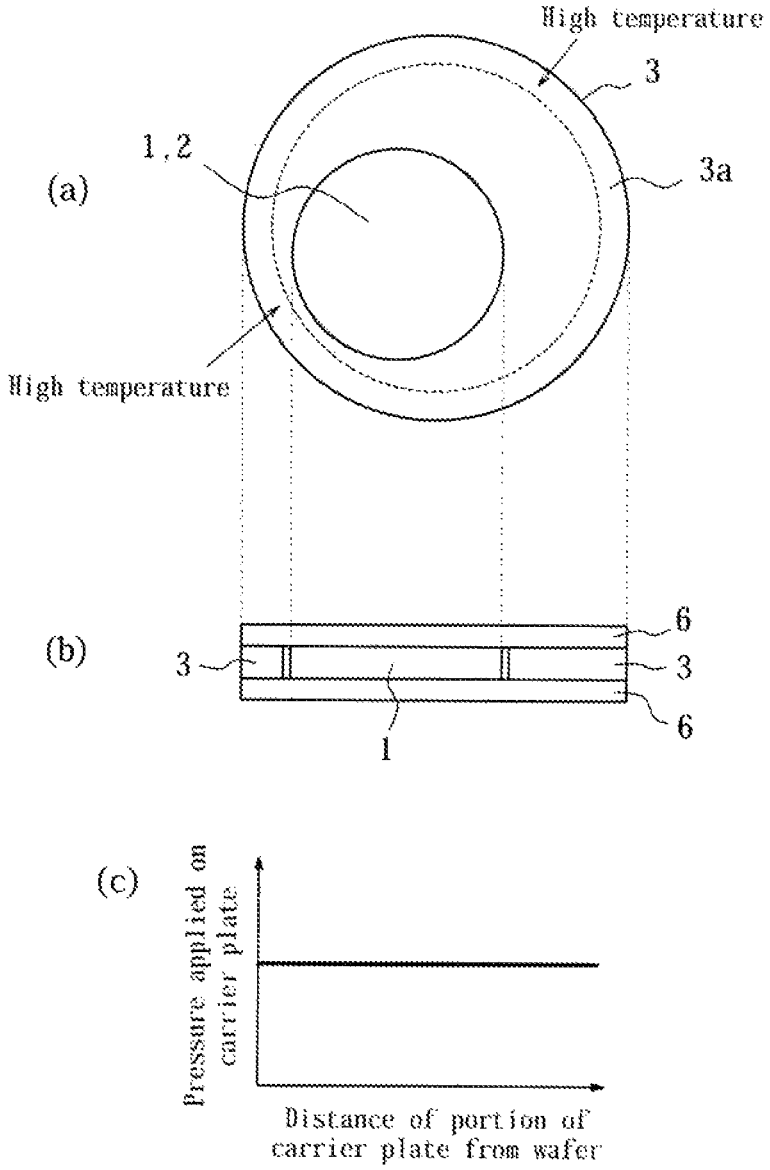
FIG. 4(*a*) is a diagram schematically showing the temperature state of the outer edge of a carrier plate.

On the other hand, as shown in FIG. 4(*b*), as polishing proceeds and the thicknesses of the wafer 1 and the carrier plate 3 become equal to each other, the polishing pads 6 are brought into uniform contact with the carrier plate 3. Accordingly, as shown in FIGS. 4(*a*) and 4(*c*), the pressure applied to the outer edge 3*a* of the carrier plate 3 by the polishing pad 6 in the circumferential direction does not vary. Temperature variation in the circumferential direction is not caused depending on the pressure variation.

However, in the state shown in FIG. 3(*b*), since the wafer 1 is thicker than the carrier plate 3, a gap G is formed. On the other hand, when polishing proceeds to the state shown in FIG. 4(*b*), the thickness of the wafer 1 equals that of the carrier plate 3. Therefore, the gap is not formed.

Accordingly, the heat of the wafer 1 is easily conduced to the carrier plate 3, and the rise in the temperature of the carrier plate 3 due to the heat becomes appreciable.

A portion of the carrier plate 3, which is less distant from the wafer 1, becomes higher in temperature.

Specifically, in polishing stages from the state shown in FIG. 4(*b*), the carrier plate 3 and the polishing pads 6 are in uniform contact with each other, whereas the heat conduction from the wafer 1 becomes appreciable. Therefore, the temperature variation in the circumferential direction of the carrier plate is inverted from the state shown in FIG. 3(*b*). In other words, the portion 3*a*, which has been relatively higher in temperature than the other portions of the carrier plate 3 in an early stage of polishing, becomes relatively lower in temperature than the other parts in the state shown in FIG. 4(*b*) or thereafter. Meanwhile, the portion, which has been relatively lower in temperature in an early stage of polishing, becomes relatively higher in temperature than the other portions in the state shown in FIG. 4(*b*) and thereafter.

Based on the aforementioned findings, the foregoing periodicity will be discussed.

When the temperature of the carrier plate is measured for example by an optical means from one direction, the temperature of the carrier plate 3 is measured in the circumferential direction while the carrier plate 3 is rotated.

Accordingly, in an early stage of polishing, periodic change in the temperature of the carrier plate 3, synchronizing with the rotation period of the carrier plate 3 is observed. The periodicity is decreased as polishing proceeds as shown in FIG. 2, and the periodicity of the temperature change is lost as the thickness of the wafer 1 approximates the thickness of the carrier plate 3.

After that, as polishing proceeds, heat conduction from the wafer 1 to the carrier plate 3 becomes appreciable as described above. Accordingly, in contrast to the early stage of polishing, a portion of the carrier plate 3, which is less distant from the wafer, becomes higher in temperature. Thus, new periodicity comes to appear in the temperature change of the carrier plate.

Such inversion of the high temperature point of the carrier plate indicates that when the temperature of the carrier plate measured in the circumferential direction is resolved into a linear component and an oscillating component, the phase of the oscillating component is inverted.

Thus, the inventors found that the phase of the oscillating component in the change of the temperature of the carrier plate, in particular, the carrier plate temperature measured in the circumferential direction serves as a favorable indication of the polishing state of the wafer.

The inventors made further discussions on the aforementioned periodicity from another point of view.

Figure 5:
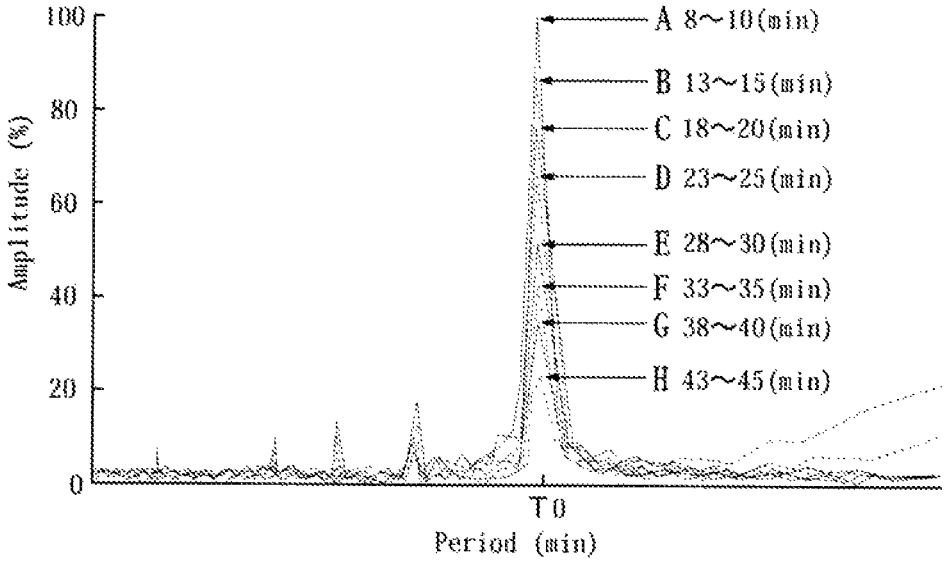
FIG. 5(*a*) is a graph showing the periodicity of the amplitude in the temperature change of a carrier plate.
Figure 5:
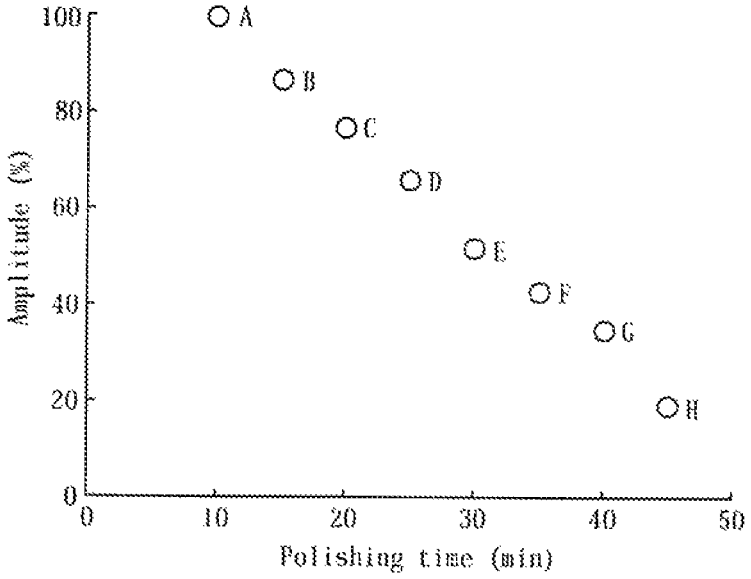

In order to reveal the characteristics of the periodic change in the temperature change of the carrier plate shown in FIG. 2, the polishing time (10 min to 45 min) is divided into eight equal time segments (A to H), and the amplitude of the oscillating component in the temperature change of the carrier plate is computed by Fourier transform with respect to the time segments A to H. FIG. 5(*a*) is a graph showing the amplitude on the period axis with respect to the aforementioned time segments.

As shown in FIG. 5(*a*), each time segment has the peak amplitude in the vicinity of TO in the rotation period of the carrier plate.

FIG. 5(*b*) is a graph of plots of peak values of the amplitudes of the time segments. As shown in FIG. 5(*b*), the peak value of the amplitude is almost linearly attenuated as the polishing time is increased.

In FIGS. 5(*a*) and 5(*b*), the amplitudes on the vertical axis are shown as relative values with the peak value of the amplitude in the time segment A (8 min to 10 min) being 100(%).

Thus, the inventors found that the amplitude of the carrier plate temperature measured in the circumferential direction also serves as a favorable indication of the polishing state of the wafer.

In view of the above, the inventors found that the carrier plate during polishing is higher in temperature than other components, and the carrier plate temperature also serves as a favorable indication of the state of contact between the carrier plate and the polishing pads, that is, the wafer thickness.

Consequently, they found that the target thickness of a wafer can be achieved by accurately controlling the amount of polishing removal by associating the carrier plate temperature measured by measuring the temperature of the carrier plate with the polishing.

As described above, it is effective to control the amount of polishing removal by grasping, in particular, the phase and the amplitude of the carrier plate temperature.

Figure 6:
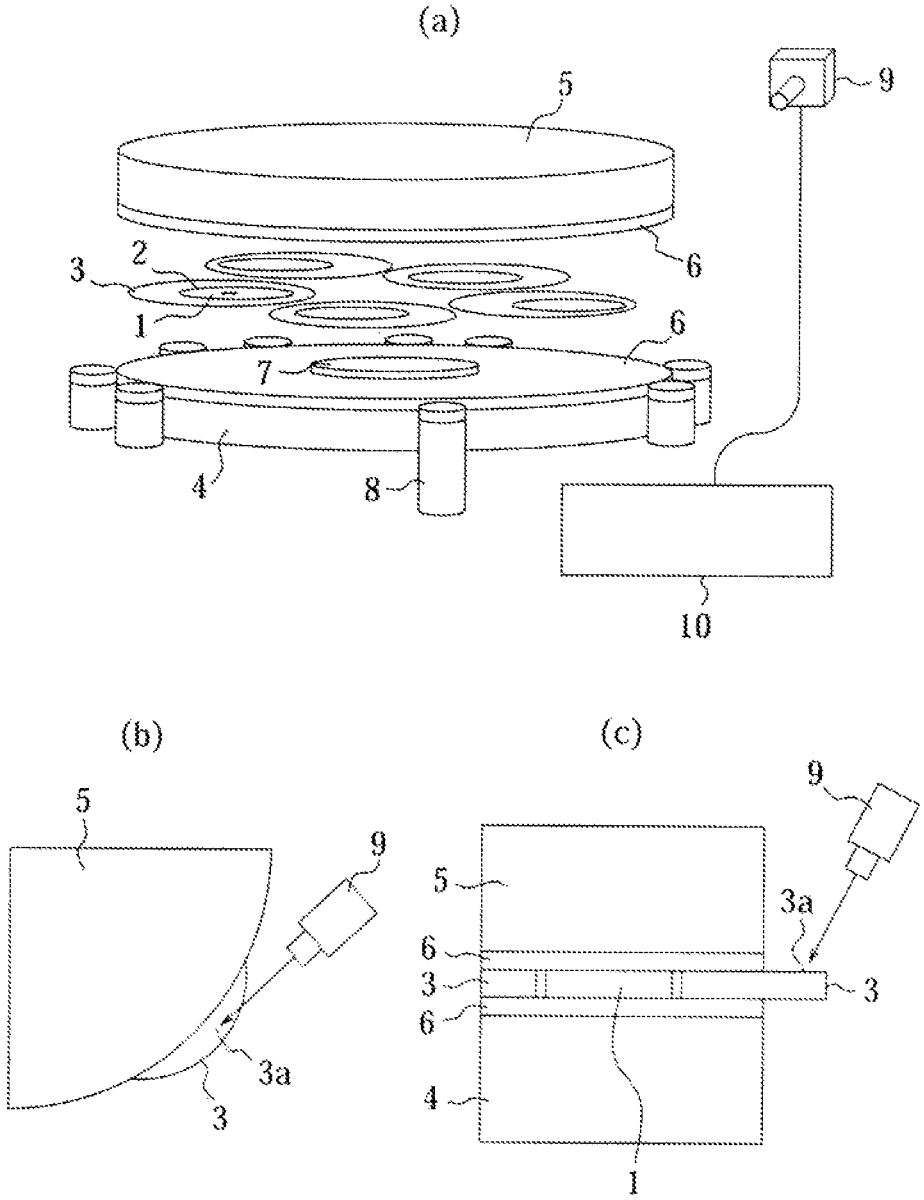
FIG. 6(*a*) is a schematic perspective view of a double side polishing apparatus for wafer in accordance with one embodiment of the present invention.

FIG. 6(*a*) is a schematic perspective view showing a double side polishing apparatus for wafer in accordance with one embodiment of the present invention.

As shown in FIG. 6(*a*), in addition to the aforementioned structure of the double side polishing apparatus including the temperature measurement means 9 for measuring the temperature of the carrier plate 3 shown in FIG. 1, the double side polishing apparatus of the present invention has a control means 10 for controlling the amount of polishing removal of a wafer in accordance with the measured temperature.

Further, the double side polishing apparatus of the present invention includes carrier plates 3 each having one or more retention openings (one in the illustration). The retention opening 2 provided in a carrier plate is eccentric to the center of the carrier plate 3.

Note that the term "eccentric" herein indicates that the center of the at least one retention opening is displaced from the center of the carrier plate. Specifically, when a carrier plate has two or more retention openings, the retention openings are necessarily eccentric irrespective of their arrangement, whereas when the carrier plate has only one retention opening, the retention opening can be arbitrarily placed as long as it is not concentric with the carrier plate.

In the double side polishing method of the present invention, the wafer 1 is retained in the retention opening 2, and the carrier plate is rotated between an upper polishing plate 5 and a lower polishing plate 4 with polishing 23 slurry being supplied, thereby relatively sliding the wafer 1 on the upper and lower polishing plates 4 and 5. Thus, the front and back surfaces of the wafer 1 can be simultaneously polished.

As shown in FIG. 1, the upper and lower polishing plates 4 and 5 can also be rotated and in this case, the upper and lower polishing plates 4 and 5 are rotated in the opposite directions.

On this occasion, in the double side polishing method of the present invention, it is important in polishing the wafer 1 that the temperature of the carrier plate 3 is measured with the temperature measurement means 9, and the amount of polishing removal of the wafer 1 is controlled by the control means 10 based on the measured temperature of the carrier plate 3.

Thus, the temperature of the carrier plate 3 is measured with the temperature measurement means 9, and the measured temperature of the carrier plate 3 is associated with the amount of polishing removal, which allows the amount of polishing removal of the wafer 1 to be controlled to the target amount of polishing removal by means of the control means 10.

Specifically, as described above, the phase in the temperature change of the carrier plate is determined, and the polishing termination point is ascertained for example by associating the phase change with the amount of polishing removal of the wafer, thereby controlling the amount of polishing removal.

Figure 7:
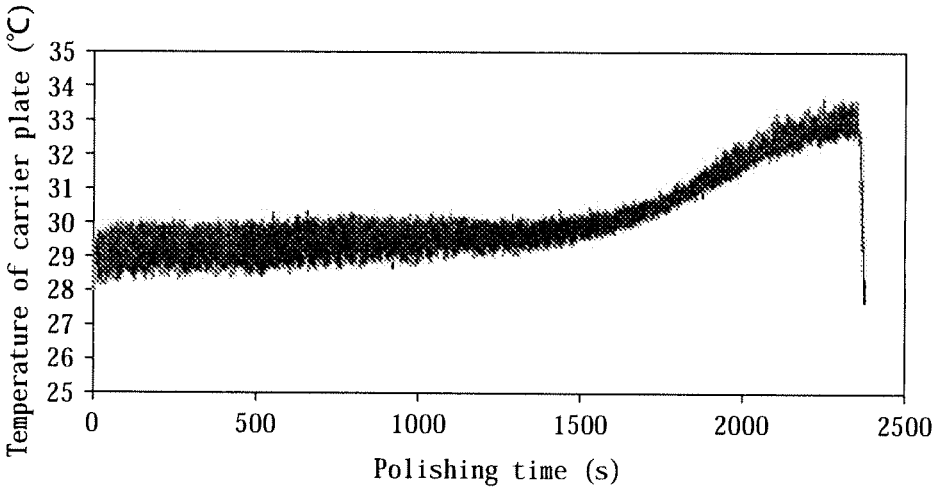
FIG. 7 is a graph showing the relationship between the polishing time and the temperature of a carrier plate.
Figure 8:
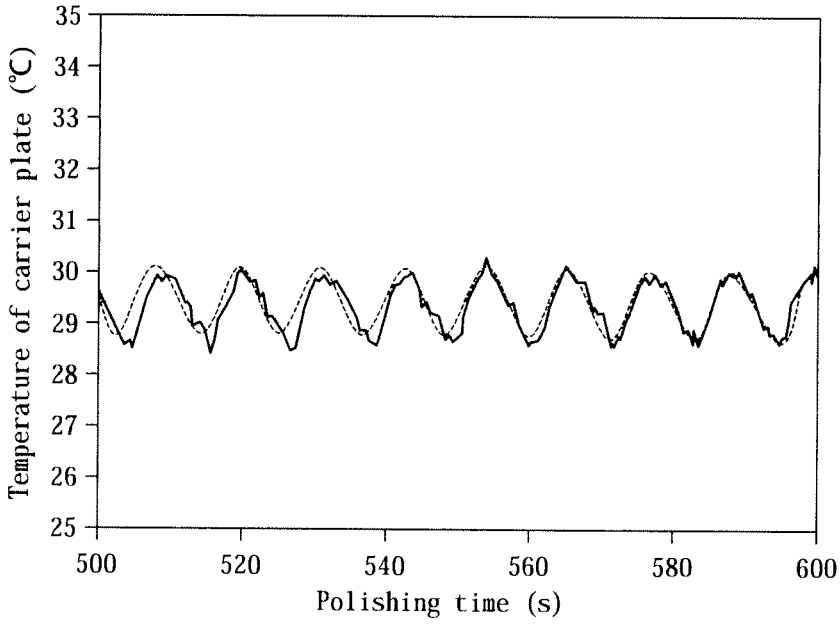
FIG. 8 is a partial close up view of FIG. 7.

FIG. 7 is a graph showing the result of measuring the temperature of a carrier plate during polishing performed on a wafer by double side polishing using the apparatus shown in FIG. 1. The solid line graph in FIG. 8 is a close up of a portion corresponding to the polishing time segment from 500 (s) to 600 (s) in FIG. 7. Note that the results of the temperature measurement shown in FIG. 7 and FIG. 8 were obtained with the use of the temperature sensor FT-H30 manufactured by KEYENCE CORPORATION as the temperature measurement means 9, at a wavelength of 8 μm to 14 μm for a sampling period of 500 ms.

As shown in FIG. 7 and FIG. 8, the temperature change of the carrier plate contains an oscillating component synchronized with the rotation of the carrier plate.

This being the case, the polishing state can be analyzed by determining the phase of the foregoing oscillating component.

The phase of the aforementioned oscillating component is not limited in particular. For example, the phase of the oscillating component can be determined by modeling the temperature of the carrier plate (the graph in solid line in FIG. 8) as shown in the formulas below (approximating the graph in broken lines in FIG. 8) and calculating the parameters A, B, C, and D by the least square method. In Formula 1 below, the first term and the second term in the right side correspond to oscillating components, whereas the third term and the fourth term correspond to linear components.

$$T=A\sin(\alpha t)+B\cos(\alpha t)+Ct+D \quad \text{(Formula 1)}$$

$$\alpha=(2\pi/60)\times r \quad \text{(Formula 2)}$$

In Formula 2, r corresponds to the rotating speed of the carrier plate, whereas the amplitude is calculated from $(A^2+B^2)^{1/2}$ and the phase θ from $\sin^{-1}\theta=B/(A^2+B^2)^{1/2}$ or $\cos^{-1}=A/(A^2+B^2)^{1/2}$.

In addition, the amplitude and the phase can also be calculated by methods such as, for example, FFT (fast Fourier transform).

The phase of the oscillating component in the temperature change of the carrier plate is found as described above, so that the thickness of the wafer with respect to the thickness of the carrier plate can be determined. For example, when the time point of the phase at which the thickness of the wafer equals the thickness of the carrier plate is the time point at which the phase is deviated (changed) by 90° (π/2) from the polishing initiation point, if a amount of polishing removal achieved at the polishing termination point, at which the thickness of the wafer is larger than the thickness of the carrier plate, is targeted, polishing is terminated before the phase change reaches to 90° (π/2). Alternatively, when polishing is performed until the thickness of the wafer becomes smaller than the thickness of the carrier plate, after the time point at which the phase change reaches to 90° (π/2), a polishing time meeting the targeted amount of polishing removal may be set in addition, to continue polishing for the set polishing time.

Next, a method for controlling the amount of polishing removal of a wafer by calculating the amplitude of the carrier plate temperature will be described.

Specifically, as described above, the amplitude of the carrier plate temperature is calculated, and the change of the amplitude is for example associated with the amount of polishing removal, thereby determining the polishing termination point. Thus, the amount of polishing removal can be controlled.

The amplitude of the carrier plate temperature can be determined for example by calculating the parameters of a model formula by the least square method as described above. Alternatively, the amplitude can be determined for example by FFT (fast Fourier Transform). However, the method for determining the amplitude is not limited to these methods.

In this occasion, for example, the time point where the amplitude of the temperature of the carrier plate 3 is minimized is determined as a time point where the thickness of a wafer equals the thickness of a carrier plate. Thus, the amount of polishing removal can be accurately controlled using the linear attenuation relation of the aforementioned amplitude.

Accordingly, when a amount of polishing removal at a time point at which the thickness of the wafer is larger than the thickness of the carrier plate is targeted as the amount of polishing removal at the polishing termination point, polishing can be terminated before the amplitude is minimized. On the other hand, when polishing is performed until the thickness of the wafer is smaller than the thickness of the carrier plate, after the amplitude is minimized, a polishing time meeting the targeted amount of polishing removal can be set in addition, thereby continuing polishing for the set polishing time.

Here, when the phase and/or the amplitude of the temperature of the carrier plate are used as indications of the amount of polishing removal of the wafer, only the phase may be used or only the amplitude may be used. Alternatively, both the phase and the amplitude may be used.

Figure 9:
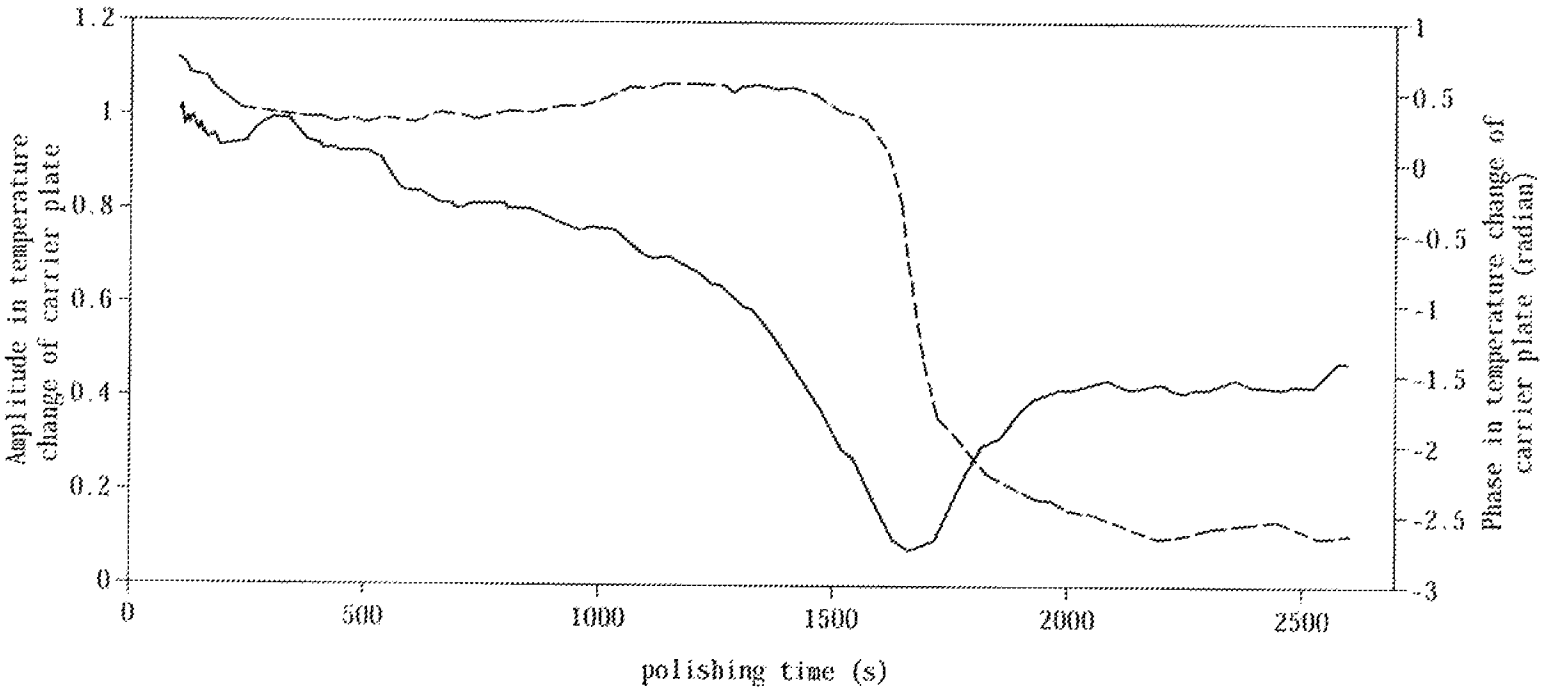
FIG. 9 is a graph showing the relationship between the polishing time and the phase and amplitude in the temperature change of the carrier plate.

FIG. 9 is a graph showing the relationship between the polishing time, and the amplitude and the phase of the oscillating component in the temperature change of the carrier plate shown in FIG. 7, which are found by the least square method.

Note that the amplitude is shown as a relative value with the amplitude at the polishing initiation point being 1.

As shown in FIG. 9, the phase (broken lines) is inverted at the time point where the thickness of the wafer almost equals the thickness of the carrier plate; therefore, the phase greatly changes around that point. On the other hand, the amplitude (solid line) gradually decreases as the thickness of the wafer approximates the thickness of the carrier plate.

Therefore, when the targeted amount of polishing removal at the polishing termination point is set to the amount of polishing removal at a time point where the thickness of the wafer equals the thickness of the carrier plate, the amplitude is preferably used as an indication.

When the polishing termination point at the targeted amount of polishing removal is set to the amount of polishing removal at a time point where the thickness of the wafer becomes smaller than the thickness of the carrier plate, the phase is preferably used as the indication.

Further, using the phase and the amplitude as the indications, for example, a criterion of change in the phase and a criterion of change in the amplitude, which correspond to the targeted amount of polishing removal, may be set such that polishing can be terminated at the time point where the both criteria are satisfied. This prevents the lack of polishing, which allows cost and time for repolishing to be reduced. Alternatively, even using both the phase and the amplitude as the indications, for example, a criterion of change in the phase and a criterion of change in the amplitude, which correspond to the targeted amount of polishing removal, may be set, and polishing can be terminated at the time point where the both criteria are satisfied, thereby further preventing overpolishing.

In this occasion, an optical means such as, for example, an infrared sensor can be used as the temperature measurement means 9.

The temperature of the carrier plate 3 may be measured, for example, by placing a temperature measurement means 9 at substantially the same height as the carrier plate 3 to measure the side surface of the carrier plate 3 as in the case shown in FIG. 1. Alternatively, as shown in FIGS. 6(*a*), 6(*b*), and 6(*c*), a temperature measurement means 9 may be placed above the upper polishing plate, and polishing can be performed with the outer edge 3*a* of the carrier plate 3 being protruded outward in a radial direction from the edges of the upper and lower polishing plates. The temperature of the protruded outer edge 3*a* of the carrier plate can be measured with the temperature measurement means 9. Thus, the temperature of the carrier plate can be accurately measured without being disturbed from radiant heat from the upper and lower polishing plates.

Further, the amplitude and its peak value may be calculated by processing the temperatures measured with the temperature measurement means 9 by means of the control means 10. Alternatively, the amplitude and the peak value may be calculated using a calculation means being provided in the temperature measurement means 9. Moreover, the calculation can be performed using another calculation means being provided to intervene between the temperature measurement means 9 and the control means 10.

On the other hand, the carrier plate of which temperature is to be measured can be made of any given material, for example, stainless steel (SUS), or fiber reinforced plastic, that is, a combination of a resin such as epoxy, phenol, or polyimide and reinforcing fiber such as glass fiber, carbon fiber, or aramid fiber. In order to improve wear and abrasion resistance, diamond-like carbon may be applied to the surface of the foregoing material.

Here, in another method of associating the measured temperature of the carrier plate 3 with the amount of polishing removal, the average of the temperature of the carrier plate 3 in each rotation cycle of the carrier plate 3 may be calculated.

With respect to the average of the temperature in each rotation cycle of the carrier plate 3, the temperature of the carrier plate 3 monotonically increases. Accordingly, when increase in the temperature of the carrier plate 3 is associated with the increase in the amount of polishing removal, the polishing termination point can be accurately determined, and the amount of polishing removal of the wafer can be accurately controlled.

On this occasion, for example, the time point where the thickness of the wafer equals the thickness of the carrier plate may be determined as a time point where the rate of increase in the carrier plate temperature per unit time falls under a certain rate, thereby associating the temperature of the carrier plate with the amount of polishing removal.

Also in this case, the temperature of the carrier plate is measured and the measured temperature is used as an indication. Thus, the desired amount of polishing removal can be achieved.

Note that instead of the mean value of the carrier plate temperature of each rotation cycle of the carrier plate, for example, the maximum value of the temperature of the carrier plate in each rotation cycle of the carrier plate may be determined such that the maximum values can be used as an indication of the amount of polishing removal.

EXAMPLES

Example 1

In order to confirm the effect of the present invention, evaluation tests were performed with respect to the relationship between the phase in the temperature change of carrier plates and the thickness and shape of wafers for varied polishing times.

Five levels of polishing times were set to be varied in the range between 29 min and 32 min.

In the test, p-type silicon wafers having a diameter of 300 mm and (100) crystal orientation were used as wafers to be polished.

For the carrier plate, a glass fiber reinforced plastic (GFRP) plate in which an epoxy resin having an initial thickness of 745 μm was combined with glass fiber was used.

Here, the center of each wafer was made to be eccentric to the center of the carrier plate by 30 mm.

An apparatus having the structure shown in FIG. 6(*a*) was used; urethane foam polishing cloth MH N15, manufactured by Nitta Haas Inc. was used as polishing pads; and Nalco 2350, produced by Nitta Haas Inco. was used as polishing slurry. The upper and lower polishing plates were rotated in opposite directions, and the carrier plate was rotated in the same direction as the upper polishing plate, thereby polishing the surfaces of the wafers.

A temperature sensor, FT-H30 manufactured by KEYENCE CORPORATION was used as a temperature sensor at a wavelength of 8 μm to 14 μm with a sampling period of 500 ms.

Figure 10:
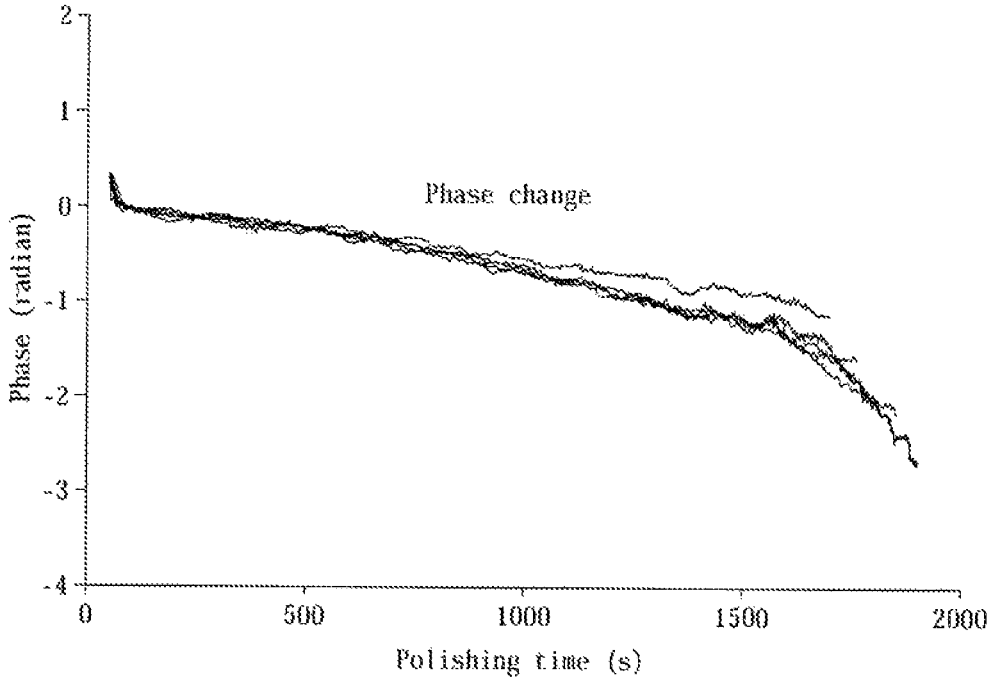
FIG. 10 is a graph showing the relationship between the polishing time and the phase in the temperature change of the carrier plate.

FIG. 10 shows results of the temperature phases of the carrier plates at the termination of polishing for varied levels of polishing times. Note that in FIG. 10, each phase at the polishing termination point on the vertical axis is shown with a relative value with the phase in the case of a polishing time of 100 s being 0.

Figure 11:
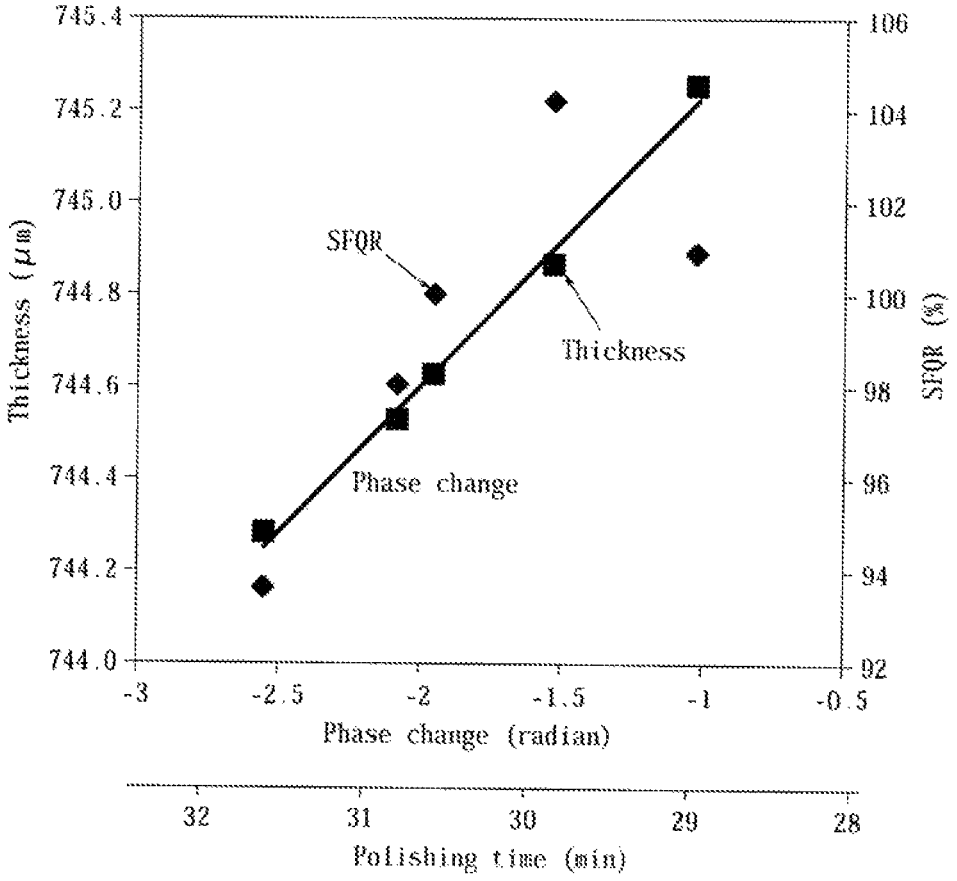
FIG. 11 is a graph showing the relationship between the phase of the temperature change of a carrier plate and the thickness and SFQR of a wafer at the point of termination of polishing.

Further, FIG. 11 shows the relationship between the phase and the thickness of a wafer at the polishing termination point and the relationship between the phase and the site front least squares range (SFQR) of the vicinity of the peripheral portion of the wafer.

This SFQR is an indication showing the flatness of the peripheral portion of the wafer according to the SEMI standard. This SFQR is specifically found by obtaining a plurality of rectangular samples having a predetermined size from the wafer and calculating the sum of the absolute values of the maximum amounts of displacement from the reference planes of the obtained samples found by the least square method.

Note that in FIG. 11, SFQR on the vertical axis and the phase at the polishing termination point on the horizontal axis are expressed as relative values with the SFQR at the polishing termination point after a polishing time of 30.5 min being 100 and with the phase after 100 s from the polishing initiation point being 0, respectively. A lower SFQR value indicates favorable flatness.

As shown in FIG. 10, increase in the polishing time is accompanied by the lowering of the phase at the polishing termination point, so that the phase change from the polishing initiation point is $\pi/2$ or more. This means that as the thickness of the wafer approximates the thickness of the carrier plate, the periodicity of temperature change is lost, and the phase is then inverted due to the inversion of the aforementioned high temperature portion.

Further, FIG. 11 shows that as the phase at the polishing termination point changes, the SFQR is diminished, so that the flatness at the outer edge of the wafer is improved.

This shows that the phase in the temperature change of the carrier plate having been measured can be associated with the amount of polishing removal, and the polishing termination point can be determined using the association, which allows the amount of polishing removal for making the wafers have the desired flatness to be accurately controlled.

Example 2

Tests were performed in a similar manner to Example 1 except that the polishing times were changed to five levels of "30, 35, 40, 45, and 50 (min)".

Figure 12:
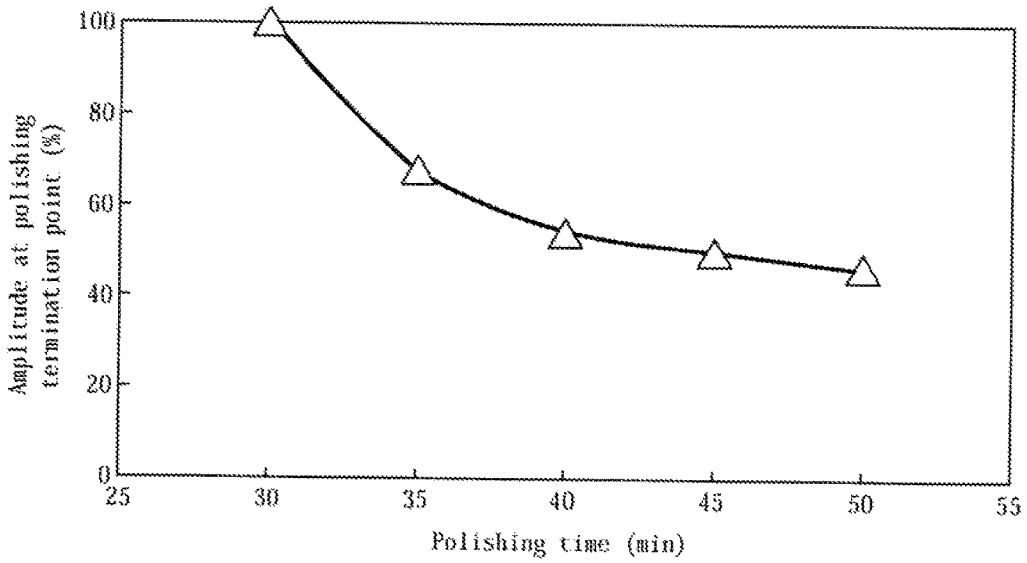
FIG. 12 is a graph showing the relationship between the polishing time and the amplitude in the temperature change of a carrier plate.

FIG. 12 shows results of the temperature amplitude of the carrier plates after polishing for varied levels of polishing times. Note that in FIG. 12, the amplitudes at the polishing termination point on the vertical axis are expressed as relative values with the amplitude at the polishing termination point after a polishing time of 30 min being 100.

Figure 13:
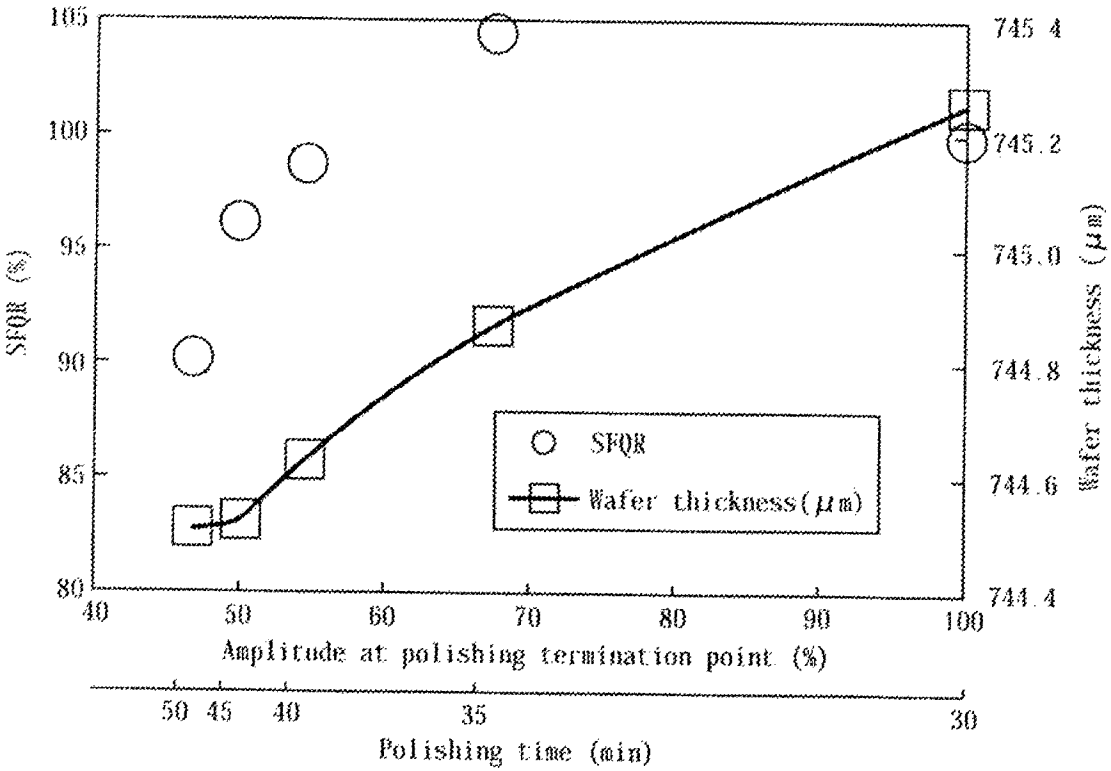
FIG. 13 is a graph showing the relationship between the amplitude in the temperature change of the carrier plate and the thickness and SFQR of a wafer at the point of termination of polishing.

Further, FIG. 13 shows the relationship between the amplitude and the thickness of a wafer and the relationship between the amplitude and the aforementioned SFQR of the vicinity of the peripheral portion of the wafer, at the polishing termination point.

Note that in FIG. 13, SFQR on the vertical axis and the amplitude at the polishing termination point on the horizontal axis are expressed as relative values with the SFQR at the polishing termination point after a polishing time of 30 min being 100 and with the amplitude at the polishing termination point being 100, respectively. Therefore, a lower SFQR indicates high flatness.

As shown in FIG. 12, increase in the polishing time is accompanied by the reduction of the amplitude at the polishing termination point. This means that as the thickness of wafers approximates the thickness of the carrier plate, the periodicity of temperature change is lost.

Further, FIG. 13 shows that as the amplitude at the polishing termination point is reduced, the SFQR is diminished, so that the flatness at the outer edge of the wafers is improved.

This shows that the amplitude of the temperature of the carrier plate having been measured can be associated with the amount of polishing removal, and the polishing termination point can be determined using the association, which allows the amount of polishing removal for making the wafers to have desired flatness to be accurately controlled.

Example 3

In order to confirm that the effect of the present invention is positive irrespective of the material of a carrier plate, tests were performed using three types of carrier plates made of different materials for evaluating the relationship between the polishing time and the amplitude of the carrier plate temperature.

The carrier plates made of three types of materials were a GFRP carrier plate, a GFRP carrier plate coated with diamond-like carbon, and a SUS carrier plate coated with diamond-like carbon.

The tests were performed under the following conditions: (1) the initial thickness of the GFRP carrier plate: 745 μm and the polishing time: 30 min; (2) the initial thickness of the GFRP carrier plate coated with diamond-like carbon: 746 μm and the polishing time: 32 min; and (3) the initial thickness of the SUS carrier plate coated with diamond-like carbon: 754 μm and the polishing time: 34 min.

The other conditions are the same as those in Example 2.

Figure 14:
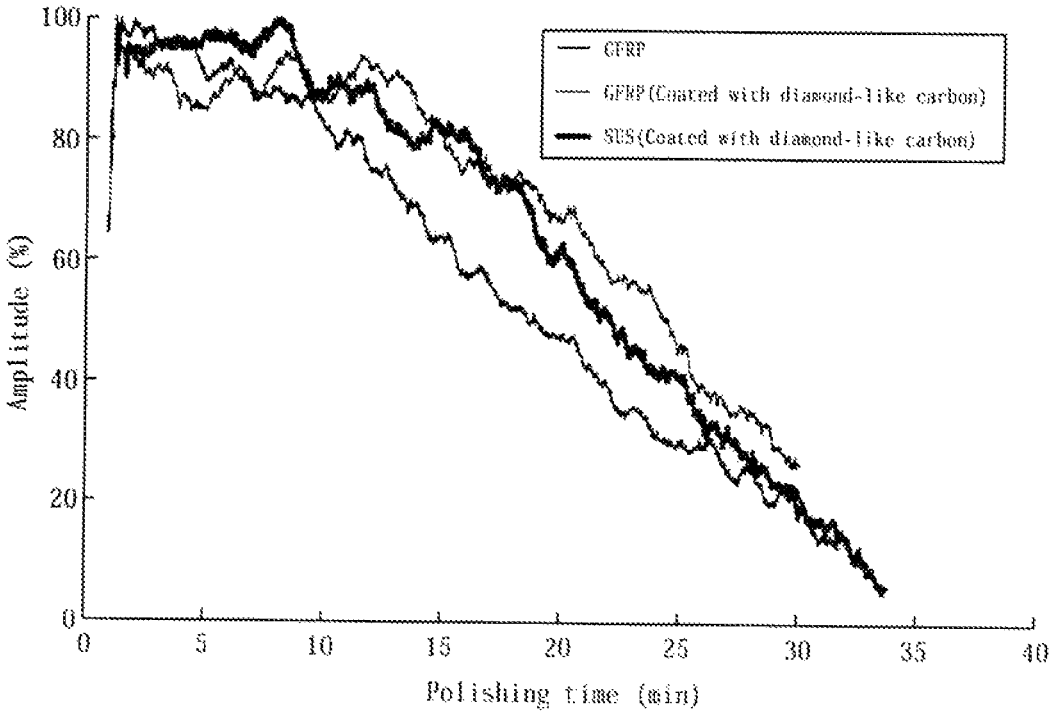
FIG. 14 is a graph showing the relationship between the polishing time and the amplitude in the temperature change of a carrier plate at the point of termination of polishing.

FIG. 14 shows evaluation results.

FIG. 14 shows that the amplitude is decreased as polishing proceeds irrespective of the material of the carrier plates and there is an approximately linear relationship between them.

Accordingly, it was found that when the temperature of a carrier plate made of any given material is measured, the amount of polishing removal of a wafer can be accurately controlled based on the measured temperature.

Example 4

Figure 15:
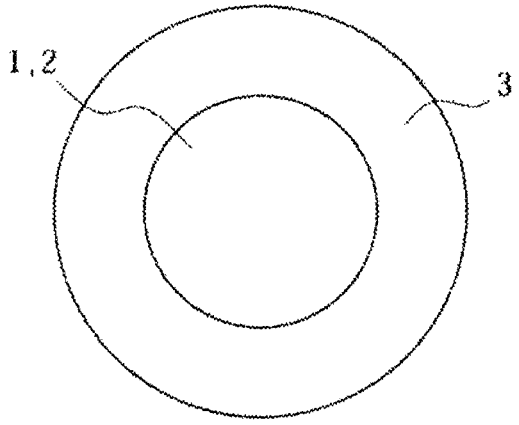
FIG. 15 is a top view showing a state where a retention opening of a carrier plate is provided concentric with the carrier plate.

For a comparative example, a carrier plate 3 in which a retention opening 2 provided concentric with a carrier plate 3 as shown in FIG. 15 was used and the temperature of the carrier plate 3 during polishing was measured. A test was performed to evaluate the periodicity of the temperature amplitude of the carrier plate 3 and its change over the polishing time.

The carrier plate used was a carrier plate made of GFRP with an initial thickness of 745 μm, and the polishing time was set to 30 (min). The other conditions are the same as those in Example 2.

Figure 16:
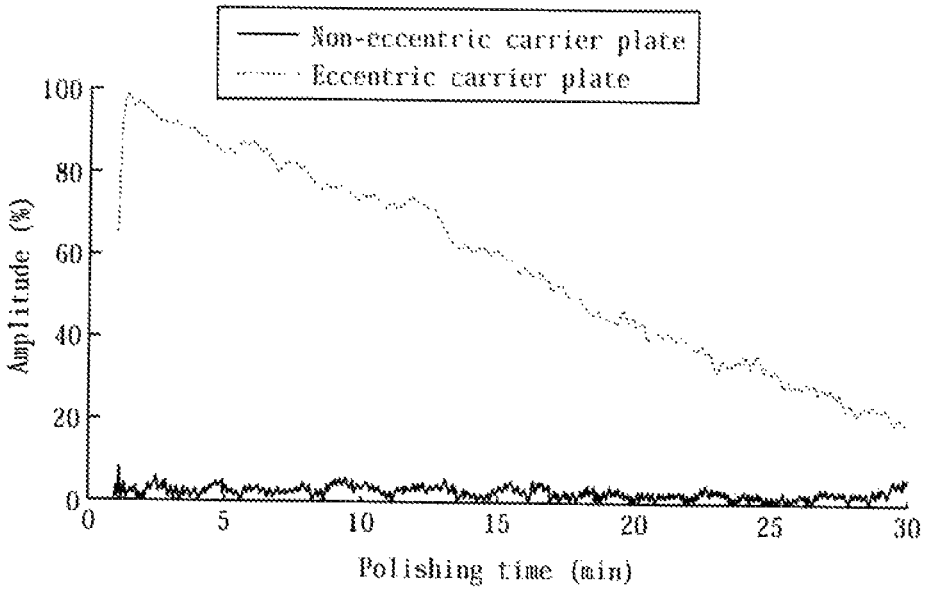
FIG. 16 is a graph showing the relationship between the polishing time and the amplitude in the temperature change of a carrier plate.

FIG. 16 is a graph showing the relationship between the polishing time and the peak value of the amplitude in the temperature change of the carrier plate.

Figure 17:
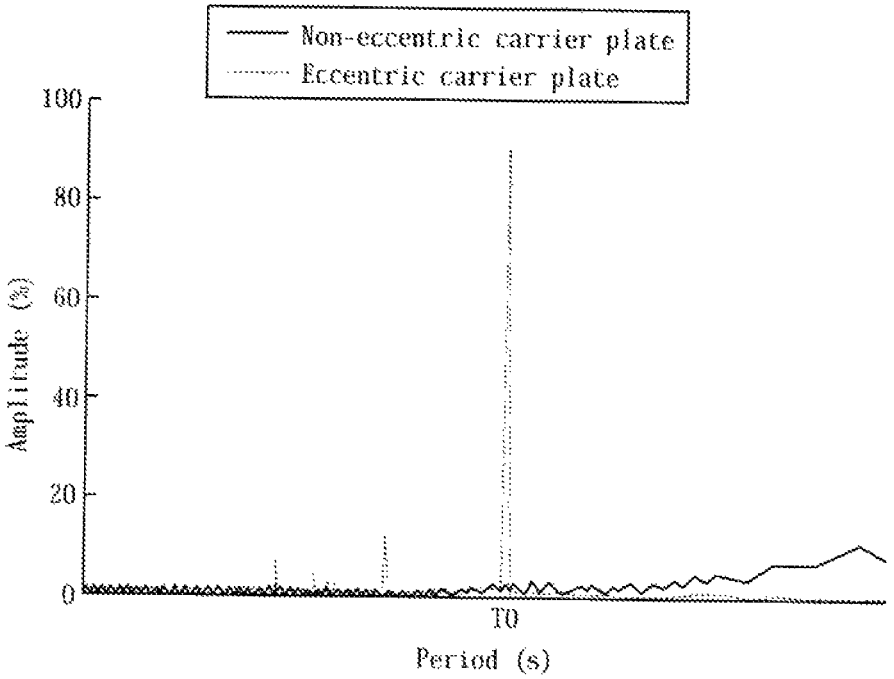
FIG. 17 is a graph showing the periodicity of the temperature of the carrier plate.

FIG. 17 is a graph showing the periodicity of the temperature of the carrier plate.

As shown in FIGS. 16 and 17, when the retention opening is not eccentric to the center of the carrier plate, the peak value of the temperature amplitude does not change over the polishing time, which leads to no periodicity in the temperature. Meanwhile, when the retention opening is eccentric to the center of the carrier plate, periodicity is found in the temperature change and the amplitude is almost linearly decreased over the polishing time.

REFERENCE SIGNS LIST

1: Workpiece (wafer)
2: Retention opening
3: Carrier plate
4: Lower polishing plate
5: Upper polishing plate
6: Polishing pads
7: Sun gear
8: Internal gear
9: Temperature measurement means
10: Amount of polishing removal control means
G: Gap

The invention claimed is:

1. A method for polishing a workpiece, in which a front surface and a back surface of the workpiece are simultaneously polished by holding a workpiece in a carrier plate having one or more retention openings each for retaining a workpiece, at least one of the retention openings being eccentrically disposed, and by rotating at least the carrier plate between an upper polishing plate and a lower polishing plate, with a polishing slurry being supplied;

wherein a temperature of the carrier plate is measured, and a termination of polishing of the workpiece is controlled based on a change in the measured temperature of the carrier plate.

2. The method for polishing a workpiece, according to claim 1, wherein the termination of polishing of the workpiece is controlled based on a change of phase calculated from the change in the temperature of the carrier plate.

3. The method for polishing a workpiece, according to claim 1, wherein the termination of polishing of the workpiece is controlled based on a change of amplitude calculated from the change in the temperature of the carrier plate.

4. The method for polishing a workpiece, according to claim 1, wherein the termination of polishing of the workpiece is controlled based on both a change of phase and a change of amplitude calculated from the change in the temperature of the carrier plate.

5. The method for polishing a workpiece, according to any one of claims 1 to 4, wherein the polishing is performed with an outer edge of the carrier plate being protruded outward in a radial direction from edges of the upper and lower polishing plates, and a temperature of the protruded outer edges of the carrier plate is measured with an optical temperature measurement means.

6. An apparatus for polishing both surfaces of a workpiece, including: a rotatable carrier plate in which one or more retention openings each for retaining a workpiece to be polished is formed, at least one of the retention openings being eccentrically disposed; and a lower polishing plate and an upper polishing plate paired with the lower polishing plate for carrying the carrier plate, comprising:

a means for measuring a temperature of the carrier plate; and a control means for terminating polishing of the workpiece in accordance with the measured temperature.

7. The apparatus for polishing a workpiece, according to claim 6, wherein the temperature measurement means is an optical measurement means.

8. A method for polishing a workpiece, in which a front surface and a back surface of the workpiece are simultaneously polished by holding a workpiece in a carrier plate having one or more retention openings each for retaining a workpiece, at least one of the retention openings being eccentrically disposed, and by rotating at least the carrier plate between an upper polishing plate and a lower polishing plate, with a polishing slurry being supplied;

wherein a temperature of the carrier plate is measured, and an amount of polishing removal of the workpiece is controlled based on a change in the measured temperature of the carrier plate, wherein the polishing is performed with an outer edge of the carrier plate being protruded outward in a radial direction from edges of the upper and lower polishing plates, and a temperature of the protruded outer edge of the carrier plate is measured with an optical temperature measurement means.

9. The method for polishing a workpiece, according to claim 8, wherein the amount of polishing removal of the workpiece is controlled based on a change of phase calculated from the change in the temperature of the carrier plate.

10. The method for polishing a workpiece, according to claim 8, wherein the amount of polishing removal of the workpiece is controlled based on a change of amplitude calculated from the change in the temperature of the carrier plate.

11. The method for polishing a workpiece, according to claim 8, wherein the amount of polishing removal of the workpiece is controlled based on both a change of phase and a change of amplitude calculated from the change in the temperature of the carrier plate.

12. An apparatus for polishing both surfaces of a workpiece, including: a rotatable carrier plate in which one or more retention openings each for retaining a workpiece to be polished is formed, at least one of the retention openings being eccentrically disposed; and a lower polishing plate and an upper polishing plate paired with the lower polishing plate for carrying the carrier plate, an outer edge of the carrier plate being protruded outward in a radial direction from the edges of the upper and lower polishing plates, comprising:

an optical measurement means for measuring a temperature of the protruded outer edge of the carrier plate; and a control means for controlling an amount of the polishing removal of the workpiece in accordance with the measured temperature.

* * * * *